US005908062A

United States Patent [19]

Fun

[11] Patent Number: 5,908,062

[45] Date of Patent: Jun. 1, 1999

[54] LIFTING TRACK OF CURTAIN

[76] Inventor: Fu-Mei Fun, No. 103, Ho Tsu Street, Ho An Li, Si Tun Area, Taichung, Taiwan

[21] Appl. No.: 09/097,642

[22] Filed: Jun. 16, 1998

[30] Foreign Application Priority Data

Sep. 2, 1997 [TW] Taiwan ..... 86214984

[51] Int. Cl.[6] ..... E06B 9/30

[52] U.S. Cl. ..... 160/170 R

[58] Field of Search ..... 160/170 R, 171 R, 160/168.1 R, 176.1 R, 177 R, 178.1 R, 166.1 R, 173 R

[56] References Cited

U.S. PATENT DOCUMENTS

| | | | |
|---|---|---|---|
| 3,141,497 | 7/1964 | Griesser | 160/170 R |
| 4,955,421 | 9/1990 | Torti | 160/170 R |
| 5,070,927 | 12/1991 | Chen | 160/171 R |
| 5,103,888 | 4/1992 | Nakamura | 160/171 R |
| 5,133,399 | 7/1992 | Hiller et al. | 160/170 R X |
| 5,328,113 | 7/1994 | Villette et al. | 160/170 R X |
| 5,725,040 | 3/1998 | Domel | 160/170 R |

*Primary Examiner*—David M. Purol
*Attorney, Agent, or Firm*—Browdy and Neimark

[57] ABSTRACT

A lifting track of curtain is composed of a track, a plurality of winding mechanisms each having a carrying seat, a cord-winding shaft, and a cord fastened at one end thereof with the cord-winding shaft and at another end thereof with the curtain. As the cord-winding shaft is turned, the cord is wound on the cord-winding shaft such that the cord slides from a large diametrical end of a cylindrical body of the cord-winding shaft toward a small diametrical end of the cylindrical body of the cord-winding shaft. The carrying seat is provided with a concave surface for preventing the intertwining of the cord at the time when the cord is wound on the cord-winding shaft.

7 Claims, 4 Drawing Sheets

LIFTING TRACK OF CURTAIN

FIELD OF THE INVENTION

The present invention relates generally to a curtain, and more particularly to a lifting track of the curtain.

BACKGROUND OF THE INVENTION

As shown in FIGS. 1 and 2 of the attached patent document, a lifting track of curtain of the prior art consists of a cord B for holding the curtain. The curtain can not be lowered or lifted in a uniform manner in view of the fact that the cord B can not be wound regularly on a cord-winding shaft A. The Taiwanese Patent Publication No. 168230 discloses a lifting track to overcome the drawback of the prior art lifting track of curtain described above. The second prior art lifting track of curtain consists of a cord-winding shaft 30 which is provided in the periphery thereof with threads and a guiding member 40 fastened with the shaft 30 such that the guiding member 40 is capable of a translational motion at the time when the cord-winding shaft 30 turns. The shaft 30 is further provided with a plurality of locating members 50 to serve as locating points at the time when the curtain is lowered or lifted. When the cord-winding shaft 30 turns, the cord 33 is guided by the guiding member 40 to wind on the shaft 30 in a regular manner. The second prior art described above is complicated in construction and is not cost-effective.

SUMMARY OF THE INVENTION

The primary objective of the present invention is to provide a curtain with a lifting track free from the drawbacks of the lifting tracks of the prior art described above.

In keeping with the principle of the present invention, the foregoing objective of the present invention is attained by a lifting track of curtain, which is composed of a track, a plurality of winding mechanisms each having a carrying seat, a cord-winding shaft, and a cord fastened at one end thereof with the cord-winding shaft and at another end thereof with the curtain. As the cord-winding shaft is turned, the cord is wound on the cord-winding shaft such that the cord slides from a large diametrical end of a cylindrical body of the cord-winding shaft toward a small diametrical end of the cylindrical body of the cord-winding shaft. The carrying seat is provided with a concave surface for preventing the intertwining of the cord at the time when the cord is wound on the cord-winding shaft.

DETAILED DESCRIPTION OF THE INVENTION

Figure 1:
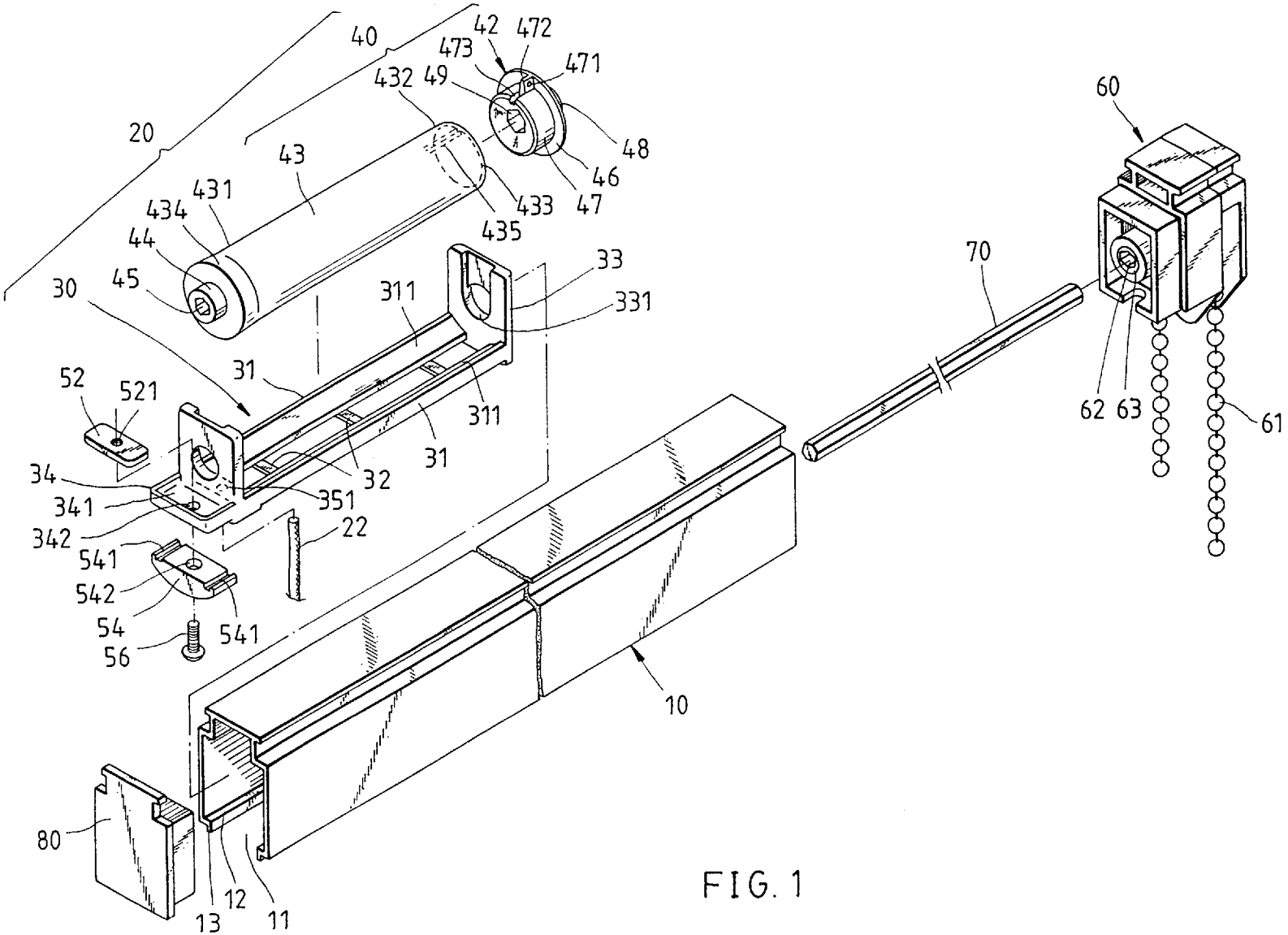
FIG. 1 shows an exploded view of a preferred embodiment of the present invention.
Figure 2:
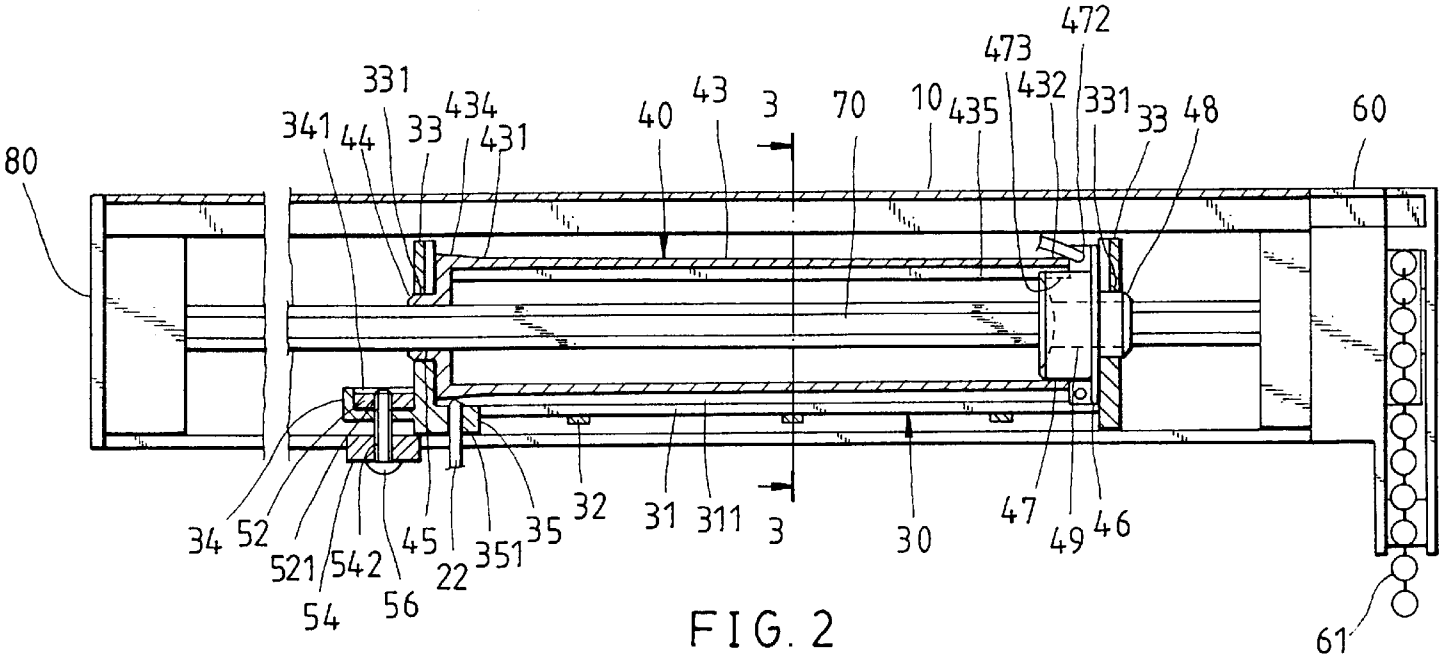
FIG. 2 shows a longitudinal sectional view of a cord-winding mechanism of the preferred embodiment of the present invention.
Figure 3:
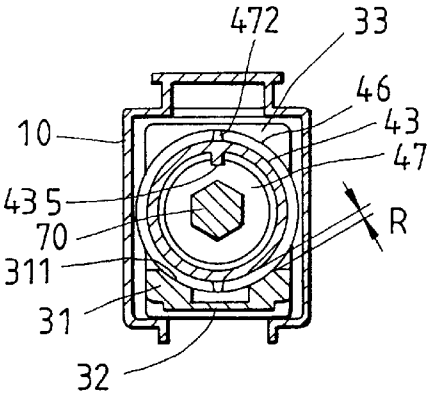
FIG. 3 shows a cross-sectional view of the cord-winding mechanism of the preferred embodiment of the present invention.

As shown in FIGS. 1–3, a curtain lifting track embodied in the present invention is composed of the component parts which are described hereinafter.

A track 10 has an inverted U-shaped cross section, an open bottom 11, and two shoulders 12 extending inward from the bottom edges of two sides of the track 10. Each of the two shoulders 12 has a protruded strip 13 extending downward from the inner edge thereof.

A predetermined number of winding mechanisms 20 are mounted in the track 10 and composed of a carrying seat 30 and a cord-winding shaft 40.

The carrying seat 30 has two base strips 31 arranged side by side. The carrying seats 30 are fastened at the bottoms thereof with a plurality of connection strips 32. Each of the base strips 31 is provided with a concave surface 311 of a length and extending along the direction of the longitudinal axis of the base strip 31. The base strip 31 is provided respectively at both ends of the longitudinal axis thereof with a pivoting portion 33 of a platelike construction and extending upward. These two pivoting portions 33 are provided at the center thereof with two pivoting holes 331 opposite to each other. One of the pivoting portions 33 is provided at the bottom end thereof with a connection portion 34 extending outwards and having a recess 341. The recess 341 is provided in the underside thereof with a through hole 342. The same one of the pivoting portions 33 is provided at the bottom end thereof with a flat plate 35 extending inward, as shown in FIG. 2. The flat plate 35 is provided with a cord hole 351. The carrying seats 30 are received in the track 10 such that both sides of the undersides of the carrying seats 30 are supported by the two shoulders 12 of the track 10.

Each of the cord-winding shafts 40 is formed of a cylindrical body 43 and an end cap 42. The cylindrical body 43 is hollow and has a smooth outer surface. The cylindrical body 43 has one end 431 which is provided coaxially with a pivot 44, and an axial hole 45 of a hexagonal construction. The cylindrical body 43 has another end 432 having an opening 433. The cylindrical body 43 is tapered from one end 431 thereof toward another end 432 thereof. The one end 431 is provided in the periphery thereof with a tapered surface 434 greater in inclination than any other portion of the cylindrical body 43. The end cap 42 has a disk body 46 which is provided with a plug portion 47 and a pivot 48 coaxial with the plug portion 47. The disk body 46, the plug portion 47 and the pivot 48 share a hexagonal axial hole 49. The plug portion 47 is provided with two fastening portions 472 each having a through hole 471. The end cap 42 is joined with one end of the cylindrical body 41 such that the plug portion 47 is inserted into the opening 433. The plug portion 47 is provided in the periphery of an outer end thereof with a slot 473, which is engaged with the protruded rib 435 of the inner wall of the cylindrical body 43. One end of a cord 22 is put through the through hole 471 of the fastening portion 472 such that the one end forms a knot 221, and that the cord 22 is wound on the cylindrical body 43, and further that another end of the cord 22 is put through the cord hole 351 of the carrying seat 30 so as to hold the curtain via the opening 11, as shown in FIG. 2. The gap R between the periphery of the cylindrical body 43 and the concave surface 311 of the carrying seat 30 is slightly greater than the diameter of the cord 22 but smaller than two times of the diameter of the cord 22, as shown in FIG. 3. The cord 22 is prevented from intertwining on the cylindrical body 43, thanks to the concave surface 311.

A plurality of connection members 52 are received in the recesses 341 of the carrying seats 30 and provided with a threaded hole 521 corresponding in location to the through hole 342. A plurality of clamping members 54 are provided with two insertion slots 541 and a through hole 542. The insertion slots 541 are engaged with the protruded strips 13 of the track 10 such that screws 56 are engaged with the threaded holes 521 of the connection members 52 via the through holes 542 and 342.

A driving mechanism 60 is mounted at one end of the track 10 such that a pull string 61 is capable of actuating the transmission shaft 63 having a connection hole 62.

A rotary shaft 70 of a hexagonal cross section is engaged with the connection hole 62 of the transmission shaft 63 and the axial holes 45, 9 of the cord-winding shaft 40 such that the rotary shaft 70 is driven by the driving mechanism 60, and that the cord-winding shaft 40 is actuated to turn.

An end cap 80 is joined with the track 10.

Figure 4:
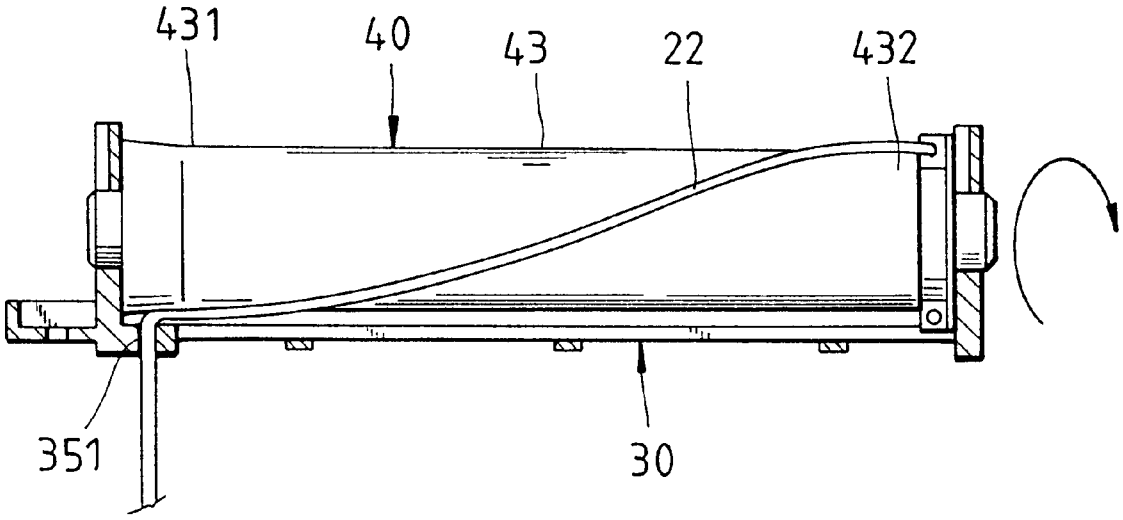
FIGS. 4–7 are schematic views of the cord-winding mechanism of the preferred embodiment of the present invention at work.
Figure 5:
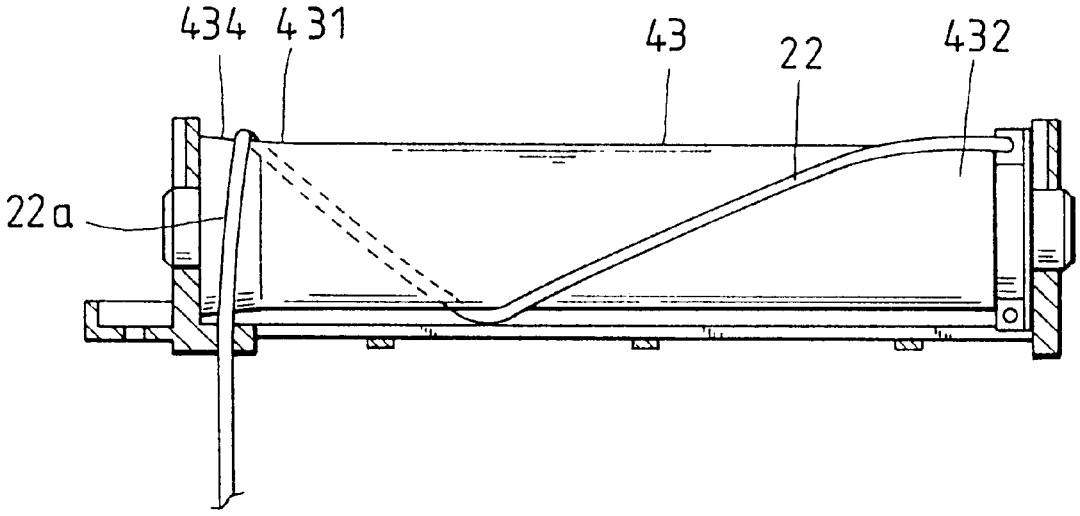
Figure 6:
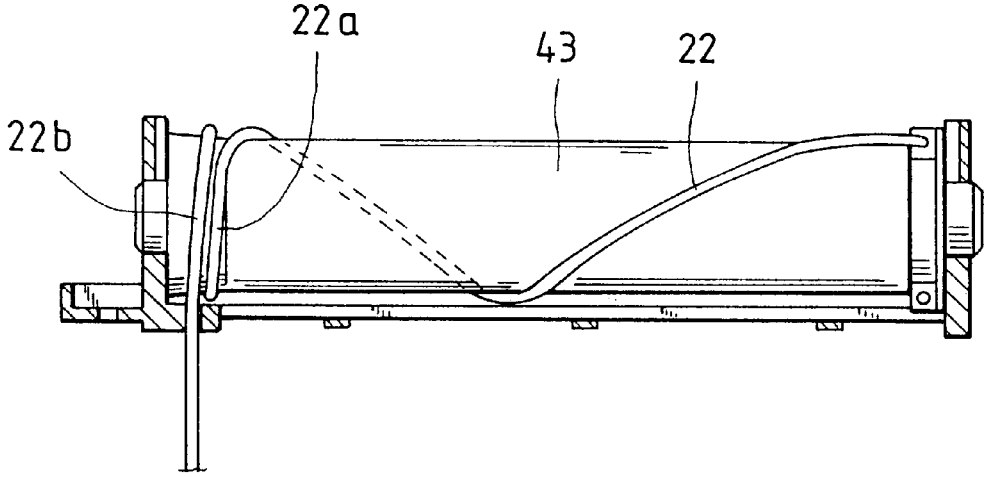
Figure 7:
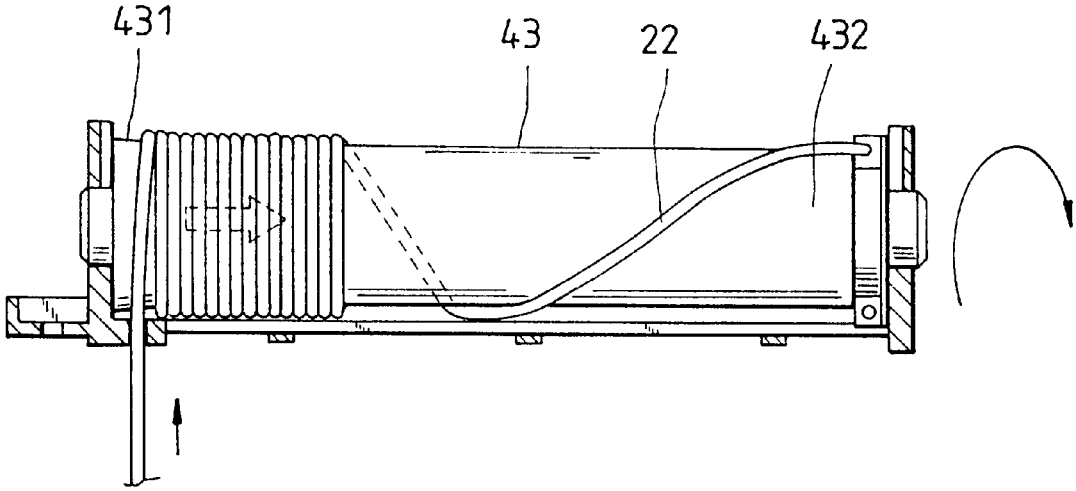

As the rotary shaft 70 and the cord-winding shaft 40 are actuated to turn by the driving mechanism 60, the cord 22 is wound or unwound on the cylindrical body 43. As shown in FIG. 4, the curtain is lowered to reach the lowest level at the time when the cord 22 is fully unwound. If the cord-winding shaft 40 is turned in the direction indicated by an arrow in the drawing, the cord located under the cord hole 351 is pulled upward such that the cord body 22*a* is forced by the tapered surface 434 to slide toward the inner side of the cylindrical body 43, as shown in FIG. 5. In the meantime, the cord body 22*b* is pulled upward continuously to wind side by side with the cord body 22*a,* whereas the cord body 22*a* slides slightly toward the small diametrical end 432 of the cylindrical body 43, as shown in FIG. 6. As a result, the cord 22 is regularly wound on the cylindrical body 43 in a good order and without being intertwined, as shown in FIG. 7.

What is claimed is:

1. A lifting track of curtain comprising:

a track having an open underside;

a plurality of cord-winding mechanisms each consisting of a carrying seat and a cord-winding shaft, said carrying seat having two pivoting portions, at least one concave surface extending between said two pivoting portions, and a cord hole, said cord-winding mechanisms being mounted in said track, said cord-winding shaft having a tapered cylindrical body with a smooth outer surface, an axial hole and a cord fastening portion located at a small diametrical end thereof, said cord-winding shaft being fastened pivotally with said two pivoting portions such that a large diametrical end of said cylindrical body is corresponding in location to said cord hole, and that a cord is fastened at one end thereof with said cord fastening portion of said cord-winding shaft, and that said cord is fastened at another end thereof with a curtain via said cord hole and said open underside of said track, said cord having a diameter smaller than a gap between a periphery of said cylindrical body and said concave surface of said carrying seat;

a driving mechanism mounted at one end of said track; and a rotary shaft located in said axial holes of said cord-winding shafts and driven by said driving mechanism to actuate said cord-winding shafts.

2. The lifting track as defined in claim 1, wherein each of said carrying seats has two base strips arranged side by side, said carrying seats being connected by a plurality of connection strips; wherein said two pivoting portions are extended respectively from two ends of a longitudinal axis of said base strips and are provided respectively with a pivoting hole; and wherein each of said cord-winding shafts is provided at both ends thereof with a pivot which is received in said pivoting hole of said carrying seat.

3. The lifting track as defined in claim 2, wherein said concave surface is located at a top of each of said base strips such that said concave surface extends along the direction of a longitudinal axis of said base.

4. The lifting track as defined in claim 1, wherein said cord-winding shafts are composed of said cylindrical body and an end cap, said cylindrical body being of a hollow construction and provided at one end thereof with an opening in communication with a hollow interior of said cylindrical body, said end cap having a disk body and a plug portion extending from one end of said disk body, said end cap being joined with said cylindrical body such that said plug portion is inserted into said opening of said cylindrical body.

5. The lifting track as defined in claim 4, wherein said cylindrical body is provided in an inner wall thereof with a protruded rib; and wherein said plug portion is provided in a periphery thereof with a slot to receive said protruded rib.

6. The lifting track as defined in claim 4, wherein said cord fastening portion is located in a periphery of said plug portion, with said periphery being adjacent to said disk body, said cord fastening portion being platelike in shape and having a through hole; and wherein one end of said cord is put through said through hole being forming a knot.

7. The lifting track as defined in claim 1, wherein said cylindrical body is provided in a periphery of said large diametrical end thereof with a tapered surface greater in inclination than any other portion of said cylindrical body.

* * * * *